US005916032A

United States Patent [19]

Stoll

[11] Patent Number: 5,916,032

[45] Date of Patent: Jun. 29, 1999

[54] COMBINATION 15-BALL AND 9-BALL BILLIARD BALL RACK

[76] Inventor: Raymond C. Stoll, 7723 Donnybrook Ct. #208, Annandale, Va. 22003

[21] Appl. No.: 08/939,698

[22] Filed: Sep. 29, 1997

[51] Int. Cl.[6] ..... A63D 15/00

[52] U.S. Cl. ..... 473/40

[58] Field of Search ..... 473/40, 41

[56] References Cited

U.S. PATENT DOCUMENTS

| | | | |
|---|---|---|---|
| D. 315,942 | 4/1991 | Cahill . | |
| 952,920 | 3/1910 | Meacham | 473/40 |
| 1,089,140 | 3/1914 | Madigan | 473/40 |
| 1,161,324 | 11/1915 | Matthay | 473/40 |
| 1,725,494 | 3/1929 | Varnum | 473/40 |
| 3,627,321 | 12/1971 | Sardo | 473/41 |
| 3,992,005 | 11/1976 | Richey | 473/40 |
| 4,469,328 | 9/1984 | Pacitti | 473/40 |
| 5,376,054 | 12/1994 | Kwasny et al. | 473/40 |

*Primary Examiner*—Theatrice Brown

*Attorney, Agent, or Firm*—Oliff & Berridge, PLC

[57] ABSTRACT

A combination billiard rack convertible between two game configuration, such as a 15-ball configuration and a 9-ball configuration. The rack includes two side members and a base member that cooperate to form a substantially equilateral triangle defining an interior area in a plane of the rack capable of receiving and racking a plurality of billiard balls. Pivotal arms are provided on each of the side members. Each is pivotal about one fixed end at a location proximate a midpoint of each side member for pivotal movement about the fixed end in the plane of the rack. The pivotal arms are pivotal between a first position in which each pivotal arm is parallel with corresponding side members and a second position located within said interior area in which the pivotal arms are non-parallel with corresponding side members and act with the side members and base member to form an internal area of a size smaller than the first configuration. One or more biased movable arms can be provided on the base member to allow fuller motion of the pivotal arms. The rack is releasably lockable in either of the two configurations.

23 Claims, 9 Drawing Sheets

COMBINATION 15-BALL AND 9-BALL BILLIARD BALL RACK

BACKGROUND OF THE INVENTION

1. Field of Invention

The invention relates to an improved billiard ball rack that will allow multiple configurations of racked balls, particularly from a 15-ball equilateral triangle shape to a 9-ball diamond shape.

2. Description of Related Art

Various games fall under the general category of pocket billiards or pool. Balls in each game are arranged during certain times of these games in a pattern at a designated location on a pool table. A common pattern is an equilateral triangle shape using fifteen (15) numbered balls. Other games use a different number of balls and patterns, one of which is a diamond pattern using nine (9) numbered balls. Racks specifically shaped and sized in these patterns are used to align balls in such games.

It is desirable to have one rack which can perform the racking responsibility for either a 9-ball or 15-ball game, as well as other billiard ball games. One benefit of such a rack is a reduction of cost to the owners of the billiard tables, by having to own and maintain one rack rather than several. A benefit to the players would also be achieved as the inconvenience of locating a second rack is eliminated.

U.S. Pat. No. 5,376,054 to Kwasny et al. discloses a multiple use billiard ball rack useful in both a 15-ball configuration and a 9-ball configuration. Side (top) legs of the rack and a bottom leg are integral and form the outline of the 15-ball configuration. Each side leg includes an elongated slot in which movable leg members can move. A pin is provided at one end of the leg member. A pair of longitudinally directed ears define a groove in which the pin can slide. As best illustrated in FIGS. 1–4, the leg members can be moved between a 15-ball configuration and a 9-ball configuration. All embodiments teach that an end of the leg members opposite the pin should be affixed to the bottom leg of the rack by connecting elements as shown in FIGS. 1, 6, 7 and 8. This rack, while providing conversion between 9-ball and 15-ball configurations, achieves this using a difficult and complicated structure that requires many user movements in order to properly position and lock the rack in the nine ball configuration and return it to the fifteen ball configuration.

U.S. Pat. No. 4,469,328 to Pacitti discloses a racking device for different billiards games that is convertible from a 15-ball configuration to a 9-ball configuration. A rack includes integral leg members that form a triangular shape. A midpoint of two side leg members include hinges for securing a movable frame thereto. The movable frame is V-shaped and positionable between first and second positions. In the first position, the V-shape overlies a corresponding V-shape at the top of rack formed by upper portions of the leg members. This is a 15-ball configuration. In the second position, the V-shaped movable frame is pivoted 180° about the hinges to form a lower half of an equilateral diamond to form a 9-ball configuration. See FIGS. 1, 4 and 6. While simple operation is achieved, this structure results in a rack with an increased height and can be difficult to use when balls are already located within the rack during transition between the two positions. Such a rack also is not capable of automatically aligning the balls into the new configuration.

U.S. Design Pat. No. D315,942 to Cahill discloses the ornamental design for a pool rack triangle. As illustrated in FIG. 2, the rack includes a lower half that forms a 15-ball triangular rack configuration while the upper half subdivides a triangle into a diamond shape section suitable as a 9-ball rack.

U.S. Pat. No. 1,089,140 to Madigan discloses a pool frame that includes a base having spring hinges at ends thereof and two side bars attached to the spring hinges at one end thereof. Ends of the side bars opposite the spring hinges include latch plates for locking the frame into a triangular pool rack configuration. The purpose of the spring-loaded frame is to allow the frame to be opened (spread laterally) after racking of the pool balls so that the frame can be removed without displacing the balls. See FIG. 1.

U.S. Pat. No. 1,725,494 to Varnum discloses a pool ball rack including a base member and side members. Ends of the base member have coil spring hinges that connect to an end of the side members. The springs urge the side members into a triangular pool rack configuration. The springs also act to squeeze together the balls. See FIG. 1.

U.S. Pat. No. 3,992,005 to Richey discloses a billiard ball rack having three arms interconnected together in a triangular shape by rotating hinges. A biasing spring exerts a force on the hinges tending to position the rack in a closed position. See FIGS. 1–3.

It is desirable to have a combination billiard rack that can simply and effectively convert from one game configuration to another configuration. Additionally, in most billiard racks, billiard balls must be placed in the appropriate shape, i.e., triangular or diamond, by a user. It is desirable to have a rack that can automatically align and position billiard balls within the rack when changing from one rack configuration to another with simple and reliable operation.

It is also desirable for a billiard rack to be able to reliably and automatically lock in either a 9-ball or 15-ball configuration so that conversion can be effectively achieved with minimal user assistance.

SUMMARY OF THE INVENTION

It is an object of the invention to provide a combination billiard ball rack that can transform from an ordinary 15-ball configuration to a different configuration, such as a 9-ball configuration.

It is a further object of the invention to provide a simple, easy to use billiard ball rack that can adapt to playing several games and is preferably releasably locked in multiple configurations.

It is yet another object of the invention to provide a combination billiard ball rack that retains overall standard 15 ball size, i.e., standard side member and base member length and overall rack height.

These and other objects are achieved by a combination billiard rack convertible between two game configuration, such as a 15-ball configuration and a 9-ball configuration. The rack includes two side members and a base member that cooperate to form an equilateral triangle defining an interior area in a plane of the rack capable of receiving and racking a plurality of billiard balls. Pivotal arms are provided on each of the side members. Each is pivotal about one fixed end at a location proximate a midpoint of each side member for pivotal movement about the fixed end in the plane of the rack. The pivotal arms are pivotal between a first position in which each pivotal arm is parallel with corresponding side members and a second position located within said interior area in which the pivotal arms are non-parallel with corresponding side members and act with the side members and base member to form an internal area of a size smaller than the first configuration.

The base member preferably includes at least one pivotal arm that is biased to one position, but is pivotal out of the way of the pivotal arms of the side members, allowing fuller movement of the side member pivotal arms and lengthening of such arms. The pivotal arms are preferably designed to be removably fixed in two or more different positions, allowing static retention of the rack in any of the two configurations without application of external forces.

BRIEF DESCRIPTION OF THE DRAWINGS

The invention will be described with reference to the following drawings, wherein like numerals refer to like elements, in which.

DETAILED DESCRIPTION OF PREFERRED EMBODIMENTS

Figure 1:
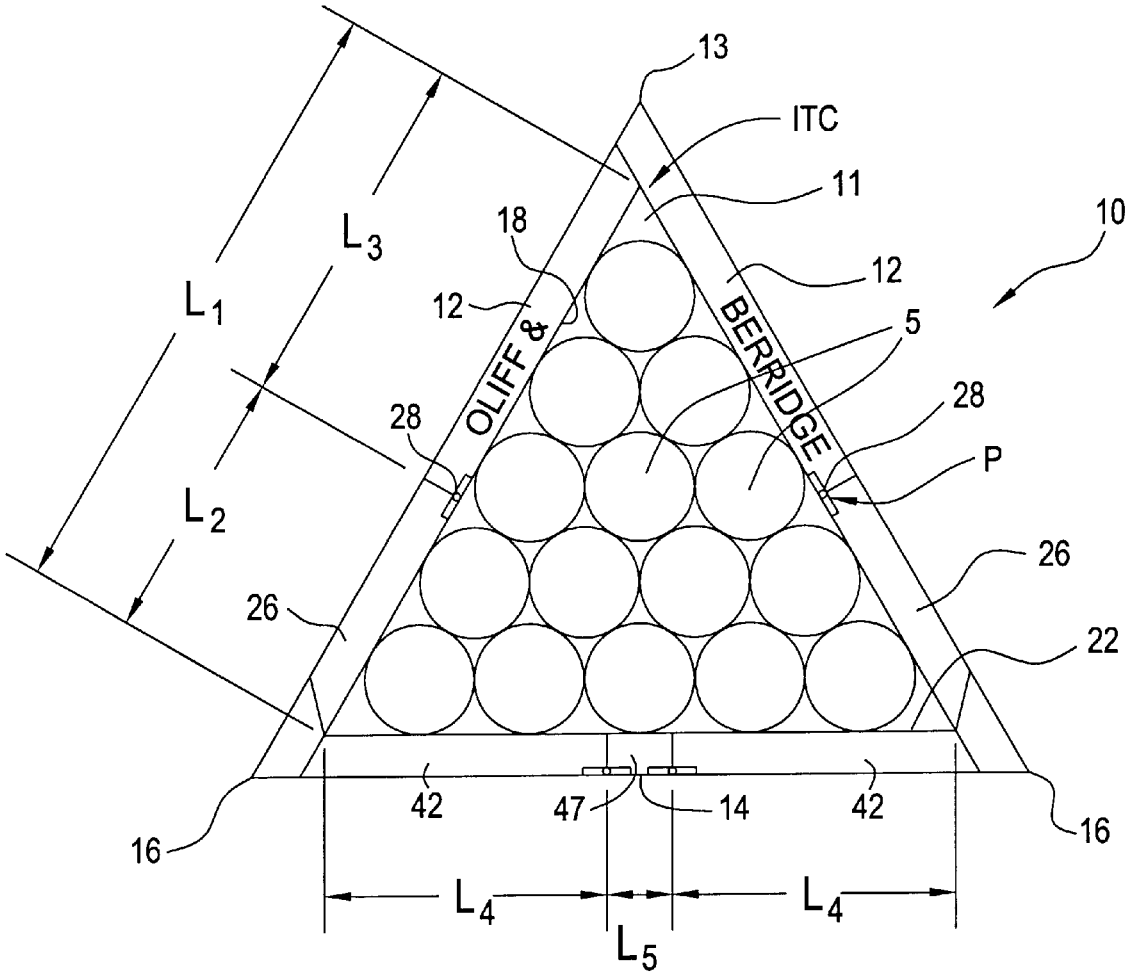
FIG. 1 shows a top view of a combination pool rack according to the invention capable of racking fifteen balls into a triangular shape.

With reference to FIG. 1, a billiard rack 10 according to the invention is shown in the normal fifteen ball configuration which will be designated as a first idle position. In the preferred construction the rack is made of wood, preferably hard wood. Rack 10 includes a pair of essentially flat side members 12 and a base member 14. Side members 12 are connected to each other at a common end portion 13 while opposing end portions 16 are connected to opposing ends of base member 14 to define a standard triangular enclosure area 11 for receiving and racking fifteen billiard balls 5. Such a triangular rack defines three substantially equal sides having a length $L_1$ of approximately 32.8 cm. Although described as three separate elements, the rack 10 could be formed as a continuous piece, such as by molding or extruding a plastic or resin, or by forming, molding or welding a metal frame.

Side members 12 and base member 14 include side inner surfaces 18, base inner surface 22, side outer surfaces 20, base outer surface 24, side and base top surface 21, and side and base bottom surface 19. Top and bottom surfaces 21, 19 are essentially flat and the bottom surface 19 may include an optional layer of material 23 applied to its surface, such as, but not limited to, felt, flock or Teflon. This optional surface may be provided to reduce wear and tear on the billiard table surface upon which rack 10 is used. The top surface 21 may be designed wide enough to convey an advertising message such as the particular bar or billiard parlor owning the table, a particular tournament, or other commercial advertisements. Rack 10 can be made of any suitable rigid material such as hardwood, although plastic and metal could also be used.

Side members 12 are each provided with pivotal arms 26, which are preferably separate pieces also constructed of rigid material and connected to side members 12 through spring hinges 28 or other suitable flexing devices that in releasing tension return the pivotal arm to the idle first position (15-ball configuration). Suitable spring hinges can be obtained from La Deau Manufacturing Corp., Glendale, Calif., part #Q9701151-1. Preferably, pivotal arms 26 maintain a uniform predetermined height H (See FIG. 5) of the rack 10. Pivotal arms 26 allow conversion of rack 10 from the standard triangular fifteen ball configuration to a nine ball configuration (second position) through simple pivotal movement of pivotal arms 26. Base member 14 is provided with pivotal arms 42, which like pivotal arms 26, are separate pieces formed preferably of rigid material and maintain the uniform height 25 of rack 10. Like pivotal arms 26, pivotal arms 42 are attached to base member 14 through spring hinges 28 or other suitable attachment and flexing devices. Pivotal arms 42 of the base member act so as to allow a fuller range of motion (angle 43) of pivotal arms 26 of side members 12.

Figure 2:
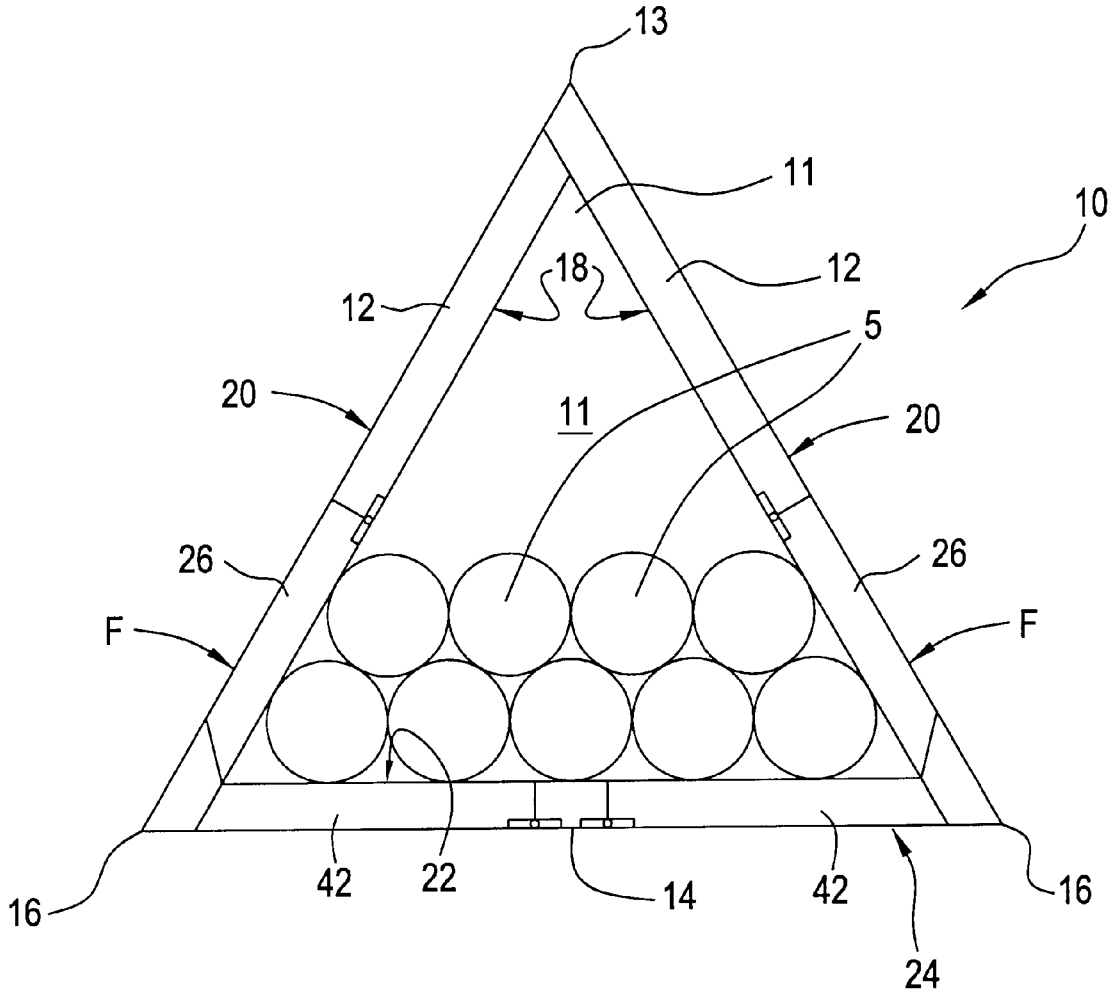
FIG. 2 shows the rack of FIG. 1 in the process of conversion to a nine ball configuration immediately upon application of force F by a user.
Figure 3:
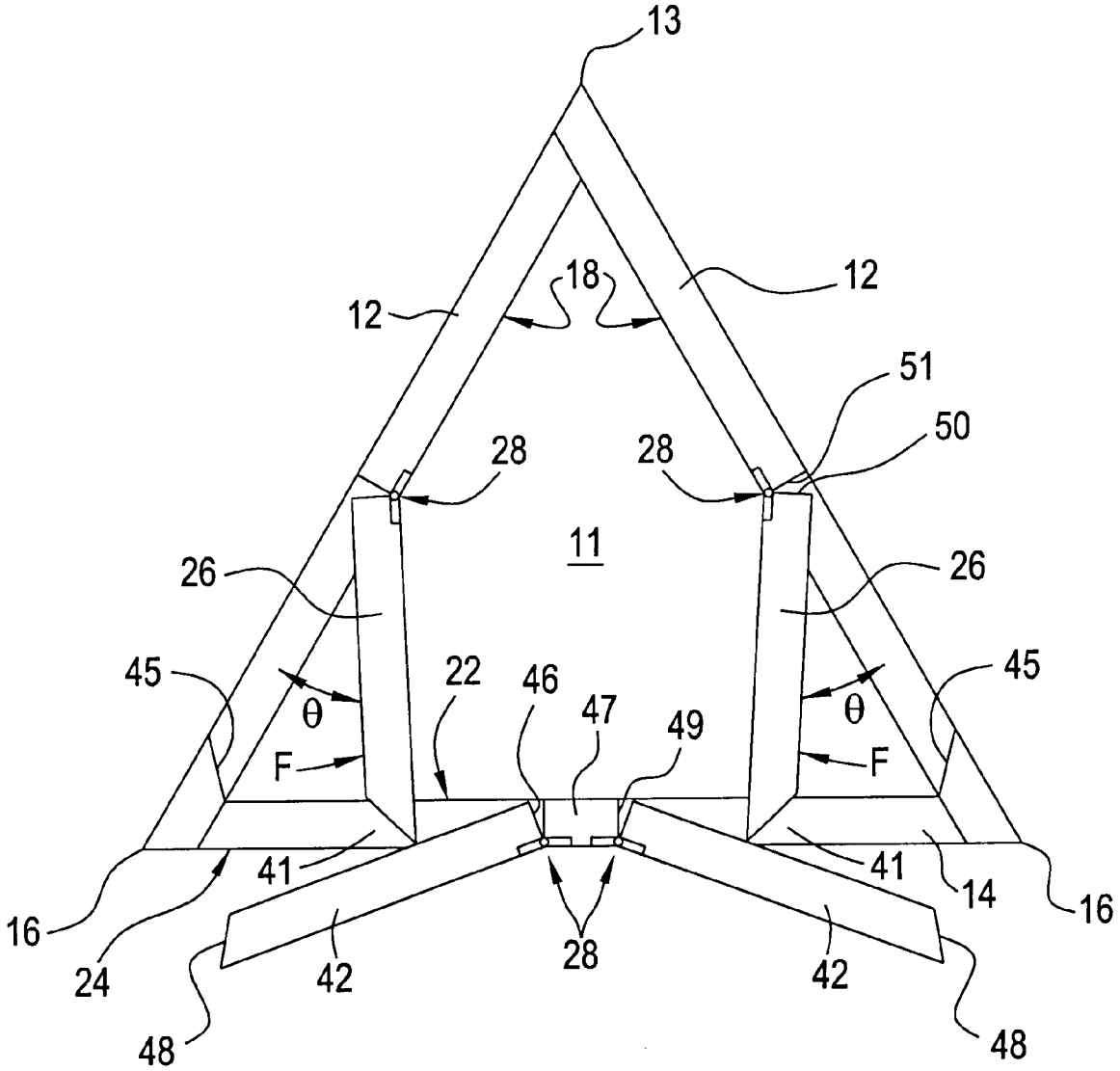
FIG. 3 shows the rack of FIG. 2 at an intermediate conversion position with continued application of force F.
Figure 4:
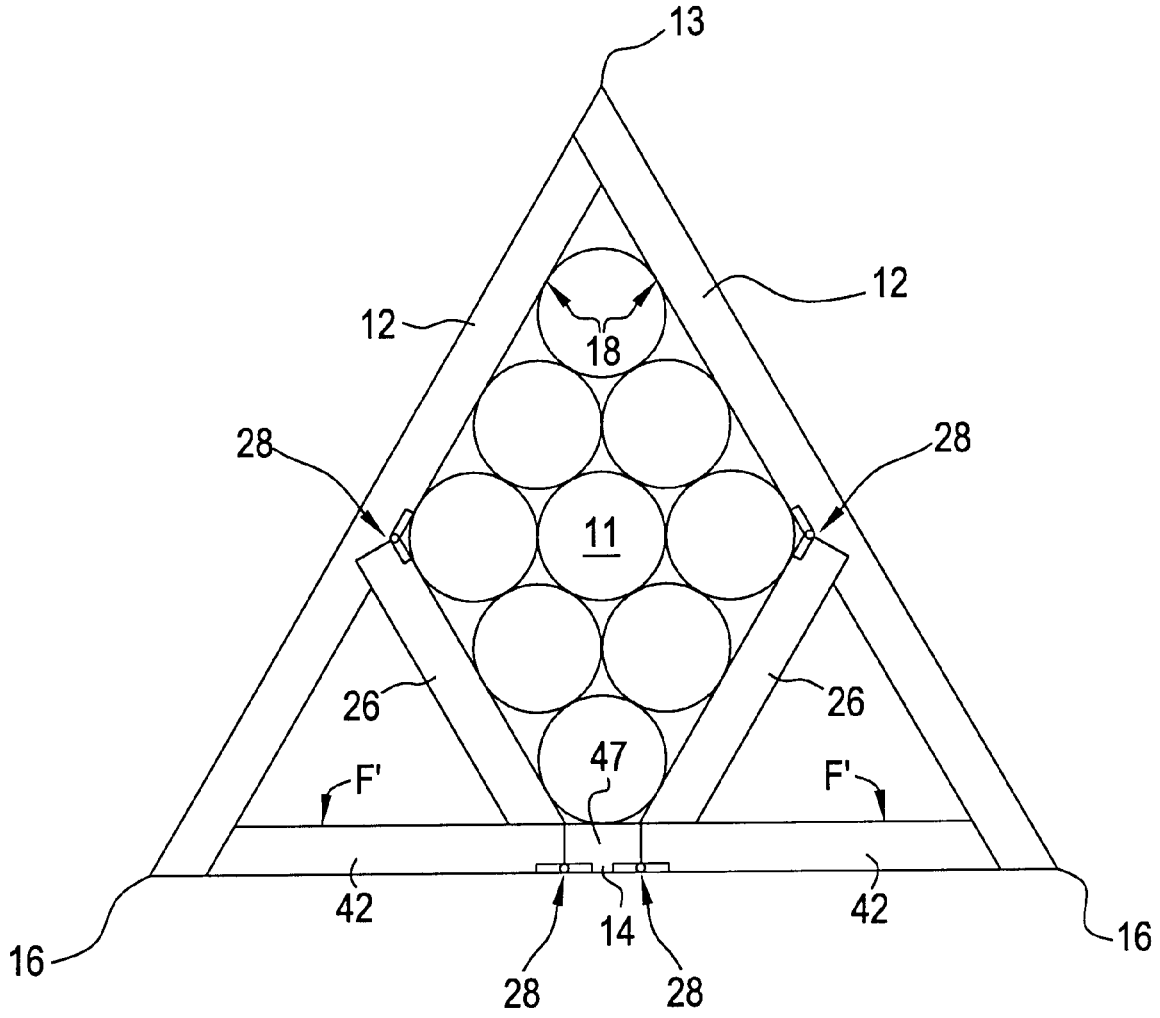
FIG. 4 shows the rack of FIG. 3 at a final nine ball configuration.

The invention allows simple, effective and precise conversion of the rack 10 from the fifteen ball configuration to the nine ball configuration through the simple movement of pivotal arms 26 by application of a force F applied to outer surfaces of pivotal arms 26 (as shown in FIG. 2) by a user. Continued application of force F pivots the pivotal arms 26 through an angle θ to the intermediate position shown in FIG. 3. Upon angular rotation of pivotal arms 26, pivotal arms 26 contact pivotal arms 42, causing them to pivot outward against the resistance of spring hinges 28 as shown. Eventually, rack 10 assumes the nine ball configuration shown in FIG. 4.

It should be noted that due to the specific preferred design of the rack, rack 10 becomes fixed in the new nine ball configuration, and will remain in such a configuration until a force F' is applied to pivotal arms 42 by a user. Then, upon sufficient rotation of pivotal arms 42 about their hinges 28, pivotal arms 26 will return to their original position in line with side members 12 due to the bias of springs 28. Upon release of force F', pivotal arms 42 return to their original position in line with base member 14. This returns the rack 10 back to the original fifteen ball configuration of FIG. 1.

A more detailed description of rack operation will now be described referring back to FIG. 3. Pivotal arms 42 are attached at a center support 47 of the base member 14 via springs 28. The bias of the springs pulls pivotal arms 42 towards the interior area 11 of the rack 10. Each pivotal arm 42 of base member 14 is prevented from entering the interior 11 by butt 46 of each pivotal arm 42 abutting against a vertical contact surface 49 of the center support 47 and, additionally, this is achieved by beveled end 48 of the pivotal arm 42 contacting the inner surface 18 of side members 12. Likewise, pivotal arms 26 are prevented from extending outward beyond side members 12 by beveled end 41, which contacts a corresponding beveled edge 45, and by butt 50, which contacts vertical contact surface 51. Beveled ends 41, 48 form an angle with the inner and outer surfaces.

Figure 5:
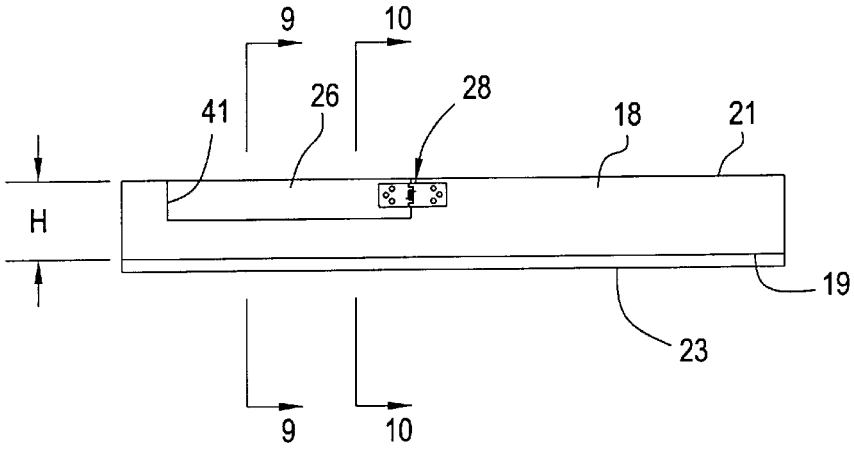
FIG. 5 shows a side view of a side member of the rack according to a first embodiment of the invention.
Figure 6:
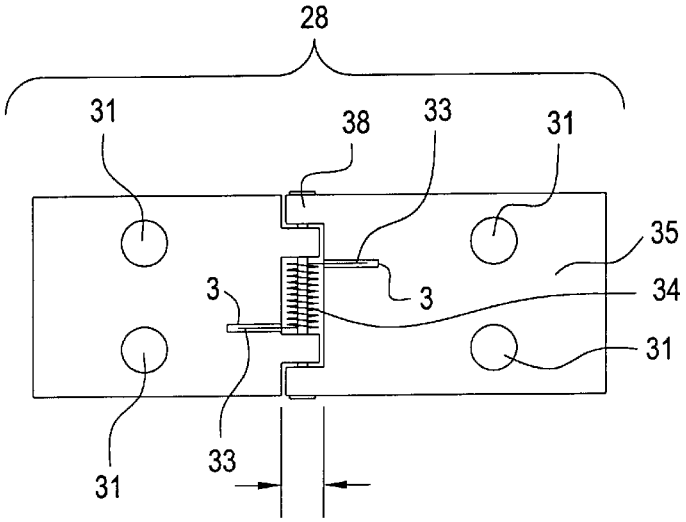
FIG. 6 shows a detailed front view of a spring hinge according to the invention.
Figure 7:
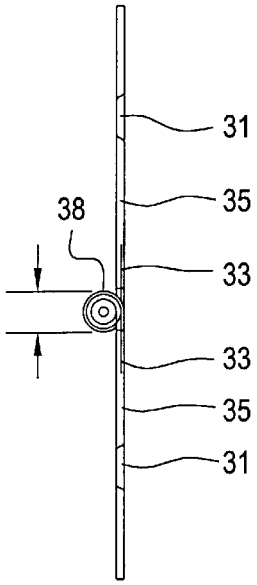
FIG. 7 shows a top view of the spring hinge of FIG. 6.
Figure 8:
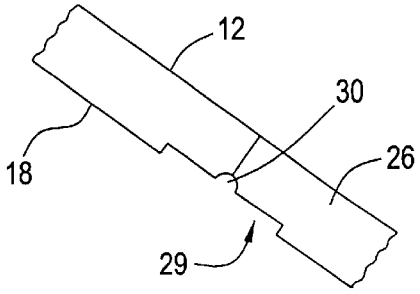
FIG. 8 shows a partial top view of a side member and pivotal arm according to the invention absent a spring hinge.

FIG. 5 shows a side view of the interior surface 18 of the left side member 12. The interior surface 18 of the side member 12 has a uniform height H. An optional layer 23 of material is shown. FIGS. 6 and 7 show detailed views of spring hinges 28. In the preferred embodiment, spring hinges 28 are mounted on the interior surfaces of side members 12, preferably not interrupting the flatness of the interior surface 18. This can be achieved by the use of recessed screw holes 31 in leaves 35 of the spring hinges and by mounting spring hinges 28 into recesses 29 (see FIG. 8) cut into pivotal arm 26 and side member 12 at an appropriate depth to maintain the continuity of the interior surface 18. Additionally, a recess 30 is cut into interior surface 18 of the side members 12 to compensate for the diameter D of knuckle 38 of spring hinge 28. To further maintain such continuity in interior surface 18, dimples 32 in leaves 35 contain ends 33 of spring 34. The spring hinges 28 attached to pivotal arms 42 are likewise configured. Alternatively, other flexing devices could be used, such as nylon hinges, living hinges, memory retention metals or other devices that return the pivotal arms to their idle position (first position).

With reference back to FIG. 1, the pivotal axis P of the pivotal arm 26 is laterally biased and located proximate to the midpoint of the side member 12, yet closer to the union point 16 of the side member 12 and base member 14 than to the union point 13 of the two side members. More particularly, the rack 10 includes an interior side (18) length $L_1$ of approximately 32.8 cm, a pivotal arm 26 length $L_2$ of between 14.2 and 14.6 cm and a length $L_3$ that is the difference of $L_1$ minus $L_2$ measured from the pivot point of the pivotal arm 26 to an inner top corner ITC of rack 10. The interior side 22 of base 14 also has a total length of approximately 32.8 cm as it is part of an equilateral triangle. Pivotal arms 42 each have a length $L_4$ of between 13.5 and 14 cm. Center support 47 has a length $L_5$, which is the total length $L_1$ minus the two pivotal arm lengths $L_4$.

Figure 9:
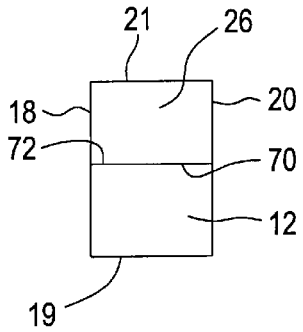
FIG. 9 shows a cross-sectional view of the side member of FIG. 5 taken along line 9—9.
Figure 10:
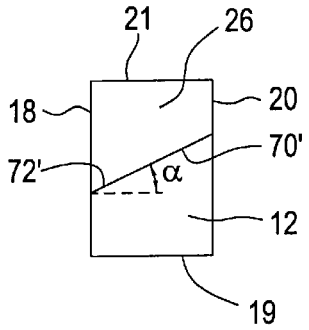
FIG. 10 shows a cross-sectional view of the side member of FIG. 5 taken along line 10—10 according to an alternative embodiment of the invention;.

FIG. 9 is a cross-sectional view of FIG. 5 taken along line 9—9 showing a flat bottom 70 of pivotal arm 26 and a corresponding flat upper surface 72 of side member 12. FIG. 10 is an alternative structure taken along line 10—10 of FIG. 5. In the FIG. 10 embodiment, beveled end 41 and corresponding beveled edge 45 further include a beveled bottom surface 70' and a corresponding surface 72' of side member 12. The beveled surface 70' is at a suitable angle $\alpha$ so as to provide a stop that prevents excessive outward travel of pivotal arm 26. Pivotal arms 42 of base member 14 can have a similar structure to prevent excessive inward travel of pivotal arms 42.

Figure 11:
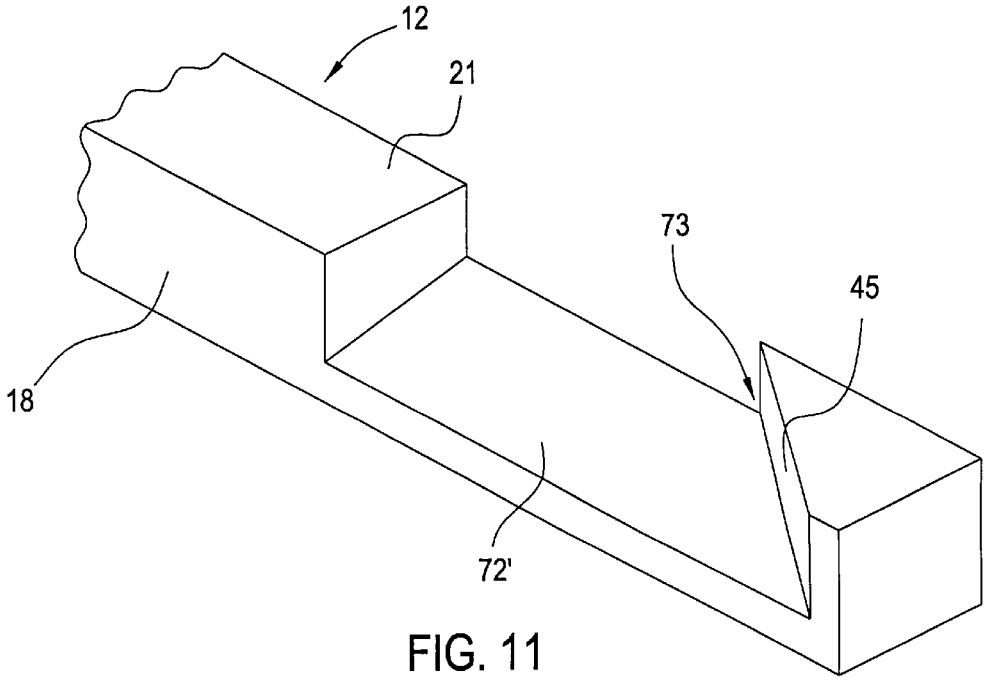
FIG. 11 shows a partial perspective view of the side member according to yet another embodiment of the invention.

FIG. 11 shows a perspective view of the FIG. 10 embodiment. The side member 12 uses both a beveled corresponding surface 72' and beveled edge 45. This results in a complex converse interior angle 73 where the horizontal and vertical beveled surfaces meet. The bottom surface and end of pivotal arms 26 are likewise configured to mate with the structure of the side member.

Figure 12:
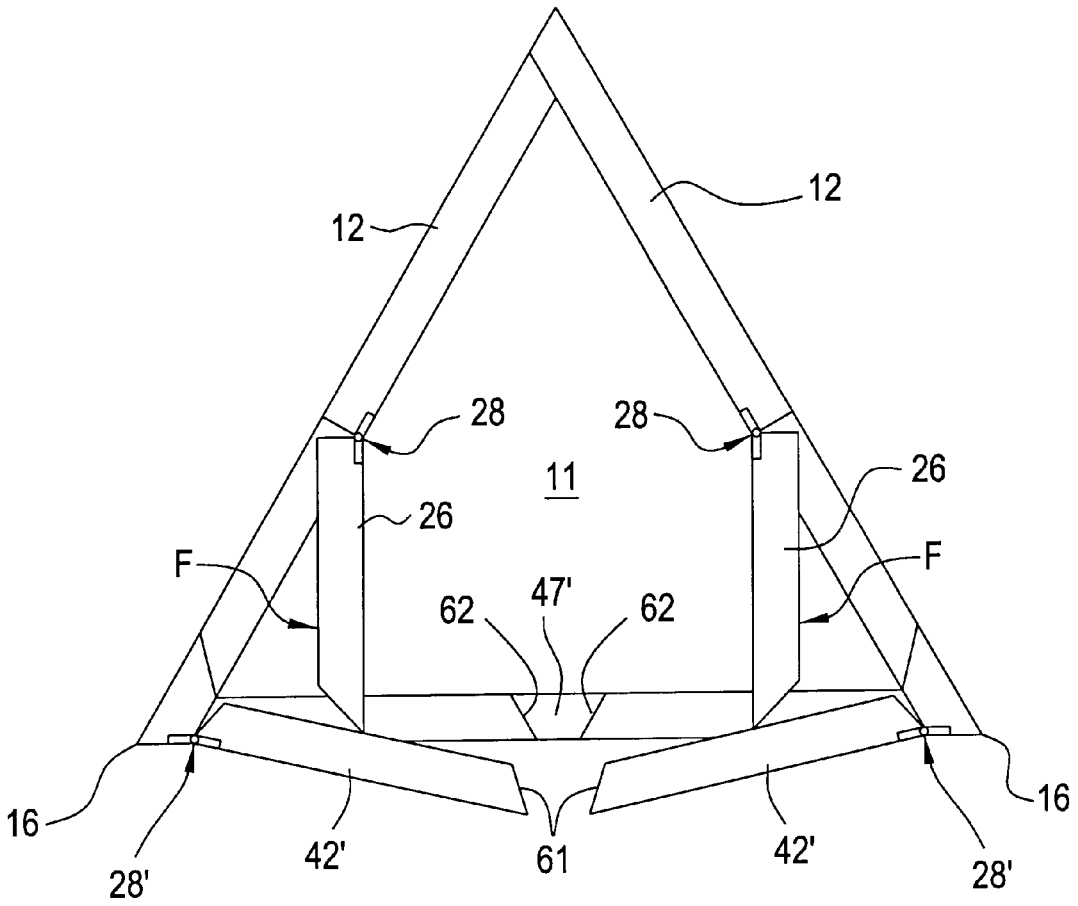
FIG. 12 shows a top view of the rack according to a further embodiment of the invention.
Figure 13:
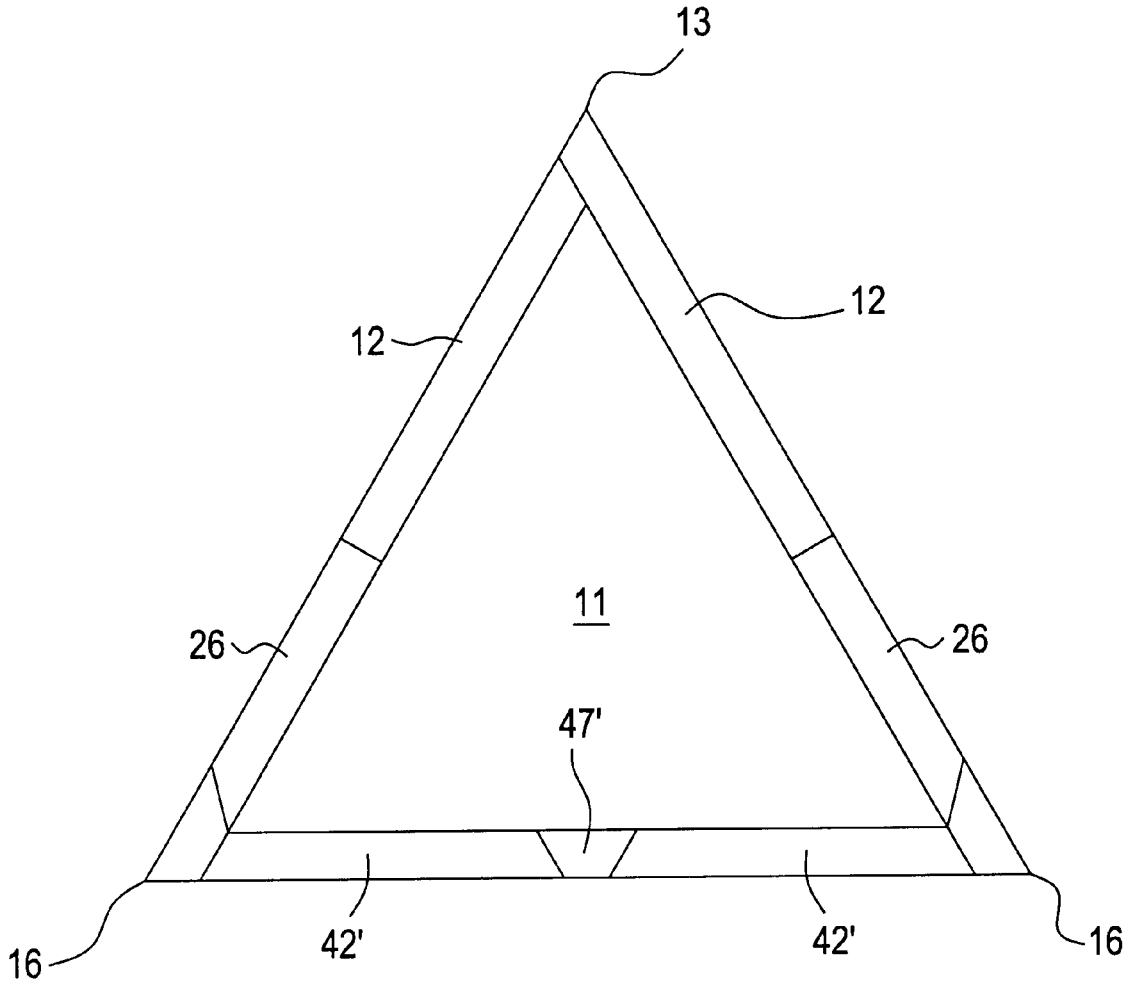
FIG. 13 shows a top view of the rack of FIG. 12 in an idle position.

FIGS. 12 and 13 show an alternative embodiment in which like numbers refer to like elements. Side members 12 and pivotal arms 26 are the same as other embodiments. However, pivotal arms 42' are provided with spring hinges 28' at their respective end nearest corner 16. Thus, the pivot points of pivotal arms 42' are located on the external surface 24 of base member 14 proximate the union 16 of the side member and the base member. This embodiment alters the center support 47' to include beveled interior vertical ends 62 that mate with corresponding beveled ends 61 of pivotal arms 42'. This embodiment achieves a structure in which the interior surface 22 is substantially flat. FIG. 12 shows a force F being applied to force pivotal arms 26 inward towards internal area 11. Upon rotation of pivotal arms 26 about their respective pivot axes, contact is made with modified pivotal arms 42' located on base member 14', which pivot as shown to allow fuller movement of pivotal arms 26 to achieve an unshown nine ball configuration in which pivotal arms 26 are positioned as in FIG. 4. FIG. 13 shows the alternative embodiment of FIG. 12 returned to an idle position (fifteen ball configuration).

Figure 14:
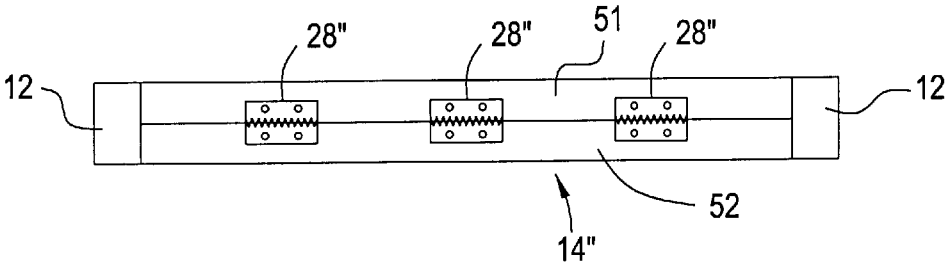
FIG. 14 shows a side view of a base member according to a further embodiment of the invention.
Figure 15:
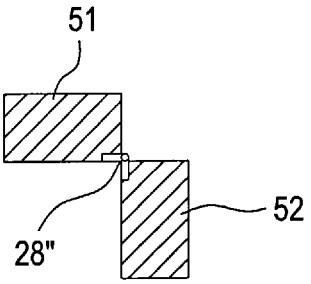
FIG. 15 shows a cross-sectional view of the rack of FIG. 16 along line 15—15.
Figure 16:
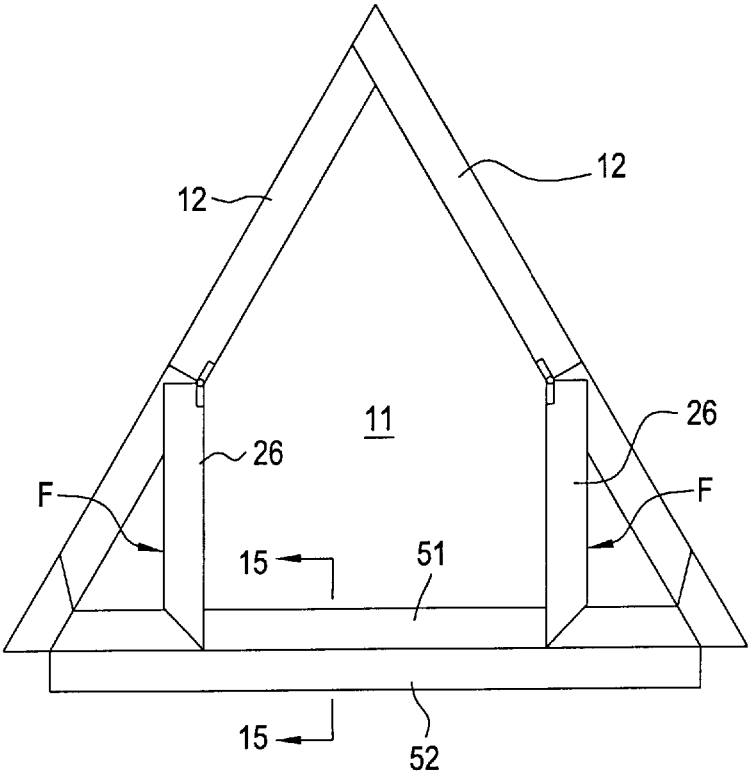
FIG. 16 shows a top view of a rack according to the embodiment of FIG. 14 during reconfiguration.

FIGS. 14–16 show a further alternative embodiment in which a modified base member 14" is provided. Side members 12 and pivotal arms 26 remain as in previous embodiments. However, base member 14" now includes a lower plate 51 and an upper plate 52 pivotally connected by spring hinges 28" to allow pivotal movement as shown in FIG. 15. The lower plate 51 is preferably fixed to side members 12 while upper plate 52 is not fixed to side members 12, and instead rests in an upright position on top of lower plate 51 when in an idle state. Upon application of a force F to pivotal arms 26 as shown in FIG. 16, pivotal arms 26 pivot inwards toward area 11 and contact the upper plate 52 of base member 14". This causes upper plate 52 to pivot as best illustrated in the cross-sectional view of FIG. 15 so as to allow fuller movement of pivotal arms 26. By proper selection of bias applied to hinges 28 and 28", the rack 10 is able to remain in either of the selected fifteen or nine ball configurations absent an external force F to revert the rack 10 back to the other of the two positions.

The invention has been described with reference to specific preferred configurations, which are intended to be illustrative and not exhaustive. Various modifications and alterations will be apparent to one of ordinary skill in the art and are intended to fall within the scope of the appended claims. For example, the present invention can be practiced to a lesser extent without use of a base member having one or more pivotal arms or plates. In such a case, to allow for fuller movement of the pivotal arms on the side members, the pivotal arms can be made to a shorter length to prevent binding with the base member. Alternatively, the arms of the base member could be designed to move into the interior of the rack with the arms of the side members cooperating via motion away from the interior of the rack.

Likewise, as previously noted, rack 10 could be made from a plastic or resin material with frame components by molding or extrusion. Alternatively, the rack could be machined or made of metal. The various components could be made by extruding or shaping or molding as appropriate with the basic frame joined to form a triangular shape by welding, riveting, crimping, nailing, gluing or other bonding. Although biased spring hinges are the preferred method of attachment and flexing, the pivotal arms of the frame could be formed of memory retentive materials and may or may not be integral to the frame. Integral living hinges and a plastic frame and pivotal arms are also contemplated as alternatives.

What is claimed is:

1. A billiard rack convertible between two game racking positions comprising:

a substantially equilateral triangle defined by two side members and a base member that cooperate to form an interior area in a plane of the rack capable of receiving and racking a plurality of billiard balls; and two pivotal arms, each pivotal arm being fixed at one end thereof to a respective one of said two side members at a point proximate a midpoint of said respective side member, for pivotal movement about said fixed point in a plane of the rack, said pivotal arms being pivotal between a first position in which each said pivotal arm is parallel with said respective side member and a second position located within said interior area in which said pivotal arms are non-parallel with said respective side member.

2. The billiard rack of claim 1, further comprising at least one spring biased hinge connecting each said pivotal arm with said fixed midpoint and biasing said pivotal arm in said first position.

3. The billiard rack of claim 1, further comprising at least one biased movable arm on said base member, said at least one biased movable arm being movable upon contact with said pivotal arm to allow passage of said pivotal arm from said first position to said second position.

4. The billiard rack of claim 3, wherein two biased movable arms are provided on said base member, each being pivotal about one end thereof at a point proximate a midpoint of said base member.

5. The billiard rack of claim 3, wherein two biased movable arms are provided on said bases member, each being pivotal about one end thereof at a point proximate an end of said base member.

6. The billiard rack of claim 3, wherein lengths of said pivotal arms and said at least one biased movable arm are selected so that said pivotal arms can be releasably fixed at said second position.

7. The billiard rack of claim 6, wherein an internal length of said side members is approximately 32.8 cm and said pivotal arms each have a length of between approximately 14.2 and 14.6 cm.

8. The billiard rack of claim 7, wherein the fixed end of each said pivotal arm is located at a position approximately 18.2 to 18.6 cm from an inner top corner of the rack.

9. The billiard rack of claim 8, wherein two biased movable arms are provided on said base member, each having a length of between 13.5 and 14 cm.

10. The billiard rack of claim 1, wherein said base member comprises a fixed lower plate and a pivotal upper plate hinged to said lower plate for rotation about a longitudinal axis of the lower plate.

11. The billiard rack of claim 1, further comprising stop means to limit travel of said pivotal arms.

12. The billiard rack of claim 1, further comprising flexing means for resisting movement of said pivotal arms and returning said pivotal arms to said first position.

13. The billiard rack of claim 12, wherein said flexing means and said pivotal arm are integral parts of said substantially equilateral triangle.

14. The billiard rack of claim 1, further comprising advertising indicia on a top surface of said rack.

15. The billiard rack of claim 1, further comprising a wear reducing material attached to a bottom surface of said rack.

16. A method of converting a billiard rack from a first game configuration to a second game configuration, the billiard rack comprising a substantially equilateral triangle formed of two side members and a base member that cooperate to define an interior area in a plane of the rack capable of receiving and racking a plurality of billiard balls and including two pivotal arms, each fixed at one end thereof to respective ones of said two side members at a fixed point for pivotal movement about said fixed point in the plane of the rack, the method comprising the steps of:

providing the pivotal arms in a first position in which said pivotal arms are substantially parallel with said side members to form a first game configuration; and applying an external force to the pivotal arms to bias the pivotal arms about the fixed point inward toward the internal area in the plane of the rack to define a second game configuration.

17. The method of claim 16, wherein the first configuration is a 15-ball configuration and the second configuration is a 9-ball configuration.

18. The method of claim 16, further comprising the step of biasing said pivotal arms to the first position using spring hinges connected between said each said side member and a corresponding one of said pivotal arms.

19. The method of claim 18, wherein the base member of the rack includes at least one biased movable arm, the method further comprising the steps of: contacting the at least one biased movable arm during the step of applying an external force to the pivotal arms, causing movement of the at least one biased movable arm of the base member away from the base member; and automatically biasing the at least one biased movable arm of the base member back towards the base member upon removal of the external force.

20. The method of claim 19, wherein two biased movable arms are provided on the base member and the step of automatic movement is accomplished by the two biased movable arms.

21. The method of claim 17, further comprising the step of placing nine billiard balls in the internal area and the step of applying external force to the pivotal arms automatically positions the nine billiard balls in the second configuration.

22. The method of claim 19, further comprising the step of providing stop means to limit rotation of the at least one biased movable arm.

23. The method of claim 16, further comprising the step of providing stop means to limit rotation of the pivotal arms.

* * * * *